US005402222A

United States Patent [19]

Haneda et al.

[11] Patent Number: 5,402,222

[45] Date of Patent: Mar. 28, 1995

[54] COLOR IMAGE FORMING APPARATUS

[75] Inventors: Satoshi Haneda; Shizuo Morita; Masakazu Fukuchi, all of Hachioji, Japan

[73] Assignee: Konica Corporation, Tokyo, Japan

[21] Appl. No.: 45,908

[22] Filed: Apr. 12, 1993

[30] Foreign Application Priority Data

Apr. 16, 1992 [JP] Japan ..... 4-096709
Apr. 16, 1992 [JP] Japan ..... 4-096720

[51] Int. Cl.[6] ..... G03G 15/00

[52] U.S. Cl. ..... 355/327; 355/211; 355/212; 355/296

[58] Field of Search ..... 355/296, 299, 326, 327, 355/211, 212, 271

[56] References Cited

U.S. PATENT DOCUMENTS

| | | | |
|---|---|---|---|
| 4,396,275 | 8/1983 | Oka et al. | 355/212 |
| 4,518,247 | 5/1985 | Nishikawa | 355/299 |
| 4,647,177 | 3/1987 | Yoshihito et al. | 355/299 |
| 5,061,966 | 10/1991 | Haneda et al. | 355/296 X |
| 5,189,472 | 2/1993 | Haneda et al. | 355/212 |
| 5,237,374 | 8/1993 | Ueno et al. | 355/299 |

FOREIGN PATENT DOCUMENTS

| | | | |
|---|---|---|---|
| 60-75850 | 4/1985 | Japan . | |
| 60-76766 | 5/1985 | Japan . | |
| 60-95456 | 5/1985 | Japan . | |
| 60-95458 | 5/1985 | Japan . | |
| 60-158475 | 8/1985 | Japan . | |
| 61-100770 | 5/1986 | Japan . | |
| 61-149972 | 7/1986 | Japan . | |
| 0071876 | 4/1988 | Japan | 355/299 |
| 0335658 | 11/1992 | Japan | 355/299 |
| 2208495 | 4/1989 | United Kingdom | 355/212 |

*Primary Examiner*—Robert B. Beatty
*Attorney, Agent, or Firm*—Frishauf, Holtz, Goodman & Woodward

[57] ABSTRACT

An image forming machine such as a copier and a printer for forming a color image on a recording sheet. The image forming machine includes: a photoreceptor for carrying the color image; an image writer such as a laser beam generator for forming a latent image of the color image on a surface of the photoreceptor; plural color developers for developing the latent image with color toners so that a developed color image is formed on the surface of the photoreceptor; a transferer for transferring the developed color image from the photoreceptor to the recording sheet; a cleaner for cleaning a residual portion of the developed color image on the photoreceptor; and a controller for controlling a cleaning operation of the cleaner which starts the cleaning operation after the transferring operation is completed. In the image forming machine, the plural color developers, the transferer, and the cleaner are located facing toward the surface of the photoreceptor, and a length of the surface between the transferer and the cleaner through the plural color developers is longer than a length of the color image. In addition, the image writer, the plurality of color developers, the transferer and the cleaning device are located in a specific order around the photoreceptor.

11 Claims, 11 Drawing Sheets

COLOR IMAGE FORMING APPARATUS

BACKGROUND OF THE INVENTION

The present invention relates to a color image forming apparatus by which a color image is formed in the following manner: when an image forming body is rotated a plurality of times, monocolor images are superimposed on the surface of the image forming body so as to form a color image; and the color image is transferred onto a transfer sheet so as to record the color image.

A large number of methods and apparatus have been proposed to provide color images by means of electrophotography. For example, the following method has been disclosed in Japanese Patent Publication Open to Public Inspection No. 100770/1986: operations of latent image formation and development; are conducted on the surface of a photoreceptor drum in accordance with the number of color separation of a document image; the formed image is transferred onto the surface of a transfer drum each time the latent image is developed so that a multicolor image is formed on the transfer drum; and then the image is transferred onto a transfer sheet to obtain a color copy. Dimensions of the aforementioned apparatus are increased and further the structure becomes complicated because it is necessary to provide to the apparatus not only a photoreceptor but also a transfer drum, the circumferential surface of which is sufficiently wide to accept an image thereon.

According to Japanese Patent Publication Open to Public Inspection No. 149972/1986, the following method has been disclosed: operations of latent image formation and development are conducted on the surface of a photoreceptor drum in accordance with the number of color separation of a document image; the image is transferred onto a transfer sheet each time it is developed so as to provide a multicolor image. In this method, multicolor images can not be superimposed with high accuracy. Therefore, it is impossible to provide images of high quality.

Also, the following method has been disclosed: operations of latent image formation and development by color toner are repeatedly conducted on a photoreceptor drum so as to superimpose color toner images on a photoreceptor; and then the superimposed image is transferred onto a transfer sheet to provide a color image. The essential process of this multicolor image forming method has been disclosed by the inventors in Japanese Patent Publication Open to Public Inspection Nos. 75850/1985, 76766/1985, 95456/1985, 95458/1985 and 15847/1985.

A method in which color toner images are superimposed on a photoreceptor is advantageous in that color images of high quality can be provided, however, it is necessary to rotate the photoreceptor drum a plurality of times in order to obtain one color image. Therefore, the copy cycle is extended.

Therefore, the efficiency of one copy cycle is improved in the following manner: the length of the photoreceptor drum circumference is determined so that the width of an image can be accommodated in the circumference in order to minimize the number of revolutions of the photoreceptor drum when toner images are superimposed; and further a transfer operation to transfer the color toner image onto a transfer sheet and a cleaning operation to clean the surface of the photoreceptor after transfer are conducted in the same rotational cycle of the photoreceptor drum.

However, in the case where the photoreceptor drum is cleaned in the same rotational cycle as that of a transfer operation, image quality is deteriorated because the transfer operation is affected when the rotational speed of the photoreceptor temporarily fluctuates being influenced by the contact pressure of the cleaning member.

The present invention has solved the aforementioned problems. It is a primary object of the present invention to provide a color image forming apparatus in which image quality is not deteriorated even when a cleaning operation is conducted on the photoreceptor drum so that color images of high quality can be always obtained effectively.

SUMMARY OF THE INVENTION

The aforementioned object can be accomplished by a color image forming apparatus including an image forming body, a charging or transfer means, an exposure means, plural developing means and a cleaning means, provided in the rotational direction of the image forming body, wherein a color image is formed when the image forming body is rotated plural times, the circumferencial interval on the photoreceptor between the transfer means and the cleaning means through the plural developing means is longer than the image forming width, and the operation of the cleaning means is started after completion of image transfer conducted by the transfer means.

The aforementioned object can be accomplished by a color image forming apparatus of another example, the color image forming apparatus including an image forming body, a charging or transfer means, an exposure means, plural developing means and a cleaning means, provided in the rotational direction of the image forming body, wherein the circumferencial interval on the photoreceptor between the transfer means and the cleaning means through the plural developing mean is longer than the image forming width, the operation of the cleaning means is started in an interval between the completion of image exposure conducted by the exposure means and image transfer conducted by the transfer means.

DETAILED DESCRIPTION OF THE INVENTION

With reference to the attached drawings, the first, second and third examples of the color image forming apparatus of the present invention will be explained as follows.

Figure 1:
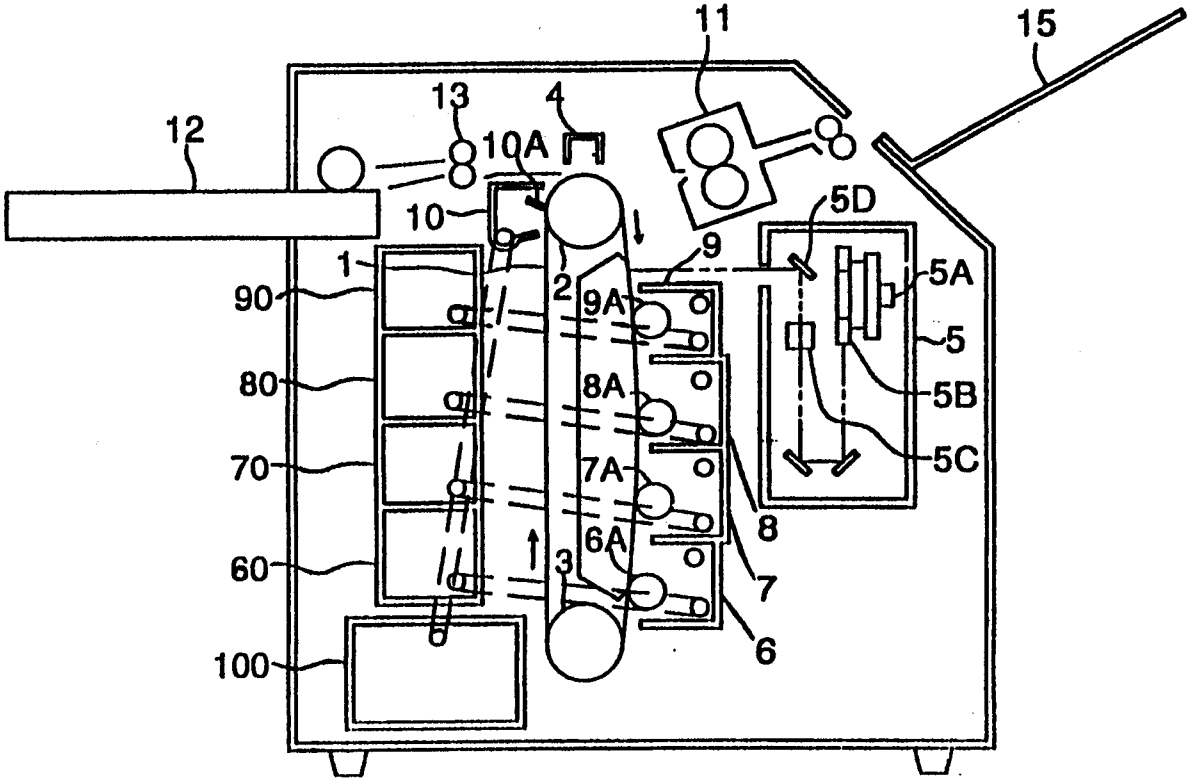
FIG. 1 is a sectional view of a color image forming apparatus of the first example of the present invention.

FIG. 1 shows the first example of the present invention. In FIG. 1, numeral 1 is a flexible photoreceptor belt that is a belt-shaped image forming body. The photoreceptor belt 1 is horizontally provided around rotational rollers 2 and 3, and when the rotational roller 2 is driven, the photoreceptor belt 1 is conveyed in the arrowed direction.

Numeral 4 is a charger that is also used as a transfer means, numeral 5 is a laser writing unit, numerals 6 to 9 are developing units in which a developer of a specific color is contained, numeral 10 is a cleaning unit, and numeral 11 is a fixing unit. The developing units 6, 7, 8, 9 are disposed in parallel along the circumferential surface of the photoreceptor belt 1. For example, developers of yellow, magenta, cyan and black are respectively contained in the developing units. The developing units are provided with developing sleeves 6A, 7A, 8A, 9A, and the gaps formed between the photoreceptor belt 1 and the developing sleeves are maintained to be a predetermined value, and a latent image on the photoreceptor belt 1 is visualized by the noncontact reversal developing method. Unlike the contact developing method, the noncontact reversal developing method is advantageous in that it does not interfere with the movement of the photoreceptor belt 1.

During the process of image formation, the blade 10A of the cleaning unit 10 is separated from the surface of the photoreceptor belt 1, and only when a cleaning operation is carried out after image formation, the blade 10A comes into pressure contact with the surface of the photoreceptor belt 1 as illustrated in the drawing.

By the color image forming apparatus, color image formation is carried out in the following manner.

In this example, multicolor image formation is carried out according to the following image forming system. That is, an original image is scanned by an image sensor in a color data input section, and the obtained data is processed in an image data processing section so that image data is made. The image data is temporarily stored in an image memory. Then, the image data is taken out from the image memory in the process of recording, and the image data is inputted into a recording section, for example, the image data is inputted into the color image forming apparatus shown in FIG. 1.

A color signal outputted from an image reading apparatus that is different from the aforementioned image forming apparatus, is inputted into the laser writing system unit 5. Then, in the laser writing system unit 5, a laser beam generated by a semiconductor laser (not shown) conducts a rotational scanning operation by the action of a polygonal mirror 5B rotated by a drive motor 5A. The laser beam passes through an $f\theta$ lens 5C, and the optical path of the laser beam is curved by a mirror 5D. Then, the laser beam is projected on the circumferential surface of the photoreceptor belt 1 onto which an electrical charge has been previously given by the charger 4, so that a bright line is formed on the photoreceptor belt 1.

Figure 11:
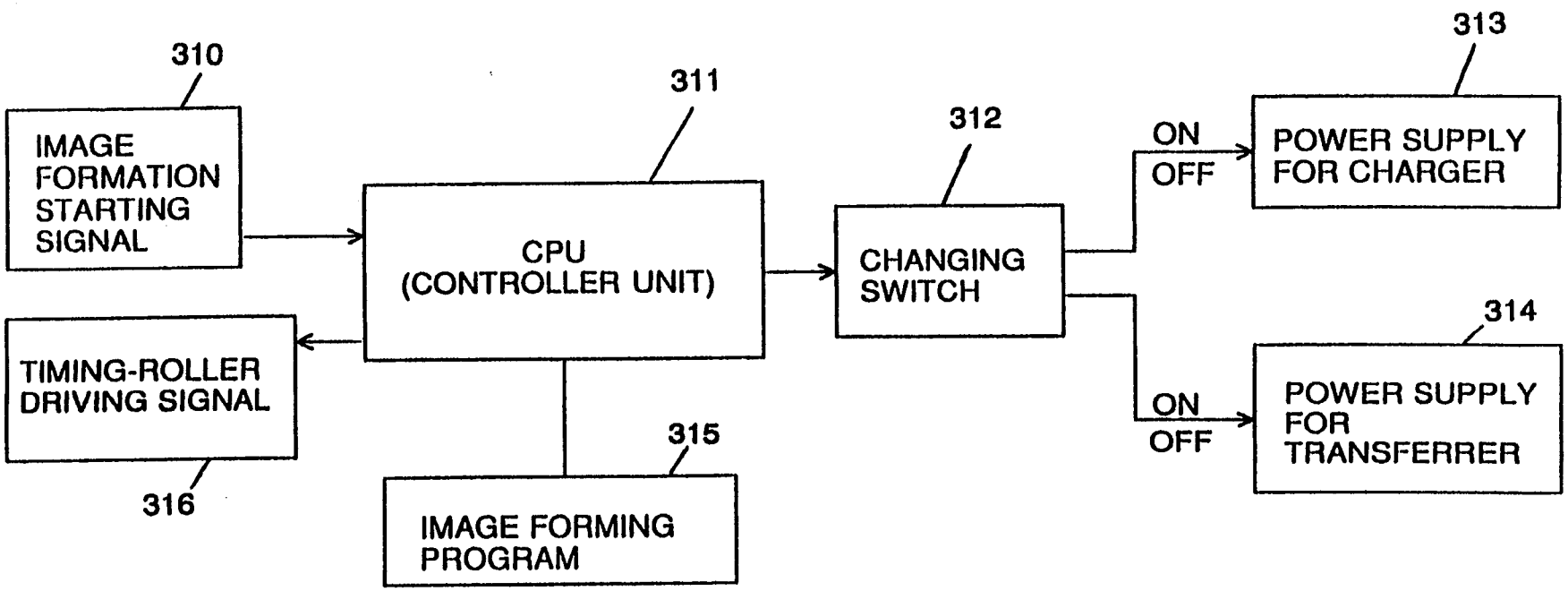
FIG. 11 is a block diagram showing the control operation of the present invention.

The charger 4 is provided with a charging electrode that is also used as a transfer electrode. As shown in FIG. 11, when an image formation start signal from unit 310 is inputted into a CPU control section 311 by pressing a copy button, a changeover switch 312 is activated, so that the electric power source for charging 313 is turned on and a voltage is impressed upon the photoreceptor belt 1. At this time, the electric power source for transfer 314 is turned off.

On the other hand, when the scanning operation is started, the beam is detected by an index sensor, and the beam modulation is started by the first color signal, so that the modulated beam scans the circumferential surface of the photoreceptor belt 1 under control of CPU 311 and the image forming programs 315. Accordingly, a latent image corresponding to the first color is formed on the circumferential surface of the photoreceptor belt 1 by the primary scanning and the auxiliary scanning, wherein the primary scanning is conducted by the laser beam, and the auxiliary scanning is conducted by the conveyance of the photoreceptor belt 1. The formed latent image is reversal-developed by the developing unit 6 loaded with yellow (Y) toner under the noncontact condition, so that a toner image is formed on the belt surface. The toner image on the belt passes under the cleaning unit 10 separated from the circumferential surface of the photoreceptor belt 1. Then, the process advances to the successive copy cycle.

The photoreceptor belt 1 is charged again by the charger 4, and then the second color signal outputted from the signal processing section is inputted into the laser writing system unit 5. In the same manner as the first color signal, a writing operation is conducted on the belt surface, so that a latent image is formed. The formed latent image is reversal-developed by the developing unit 7 loaded with magenta (M) toner under the noncontact condition.

The magenta (M) toner image is formed with the presence of the yellow (Y) toner image that has already been formed.

Numeral 8 is a developing unit loaded with cyan (C) toner. By the developing unit 8, a cyan (C) toner image is formed on the belt surface in accordance with a control signal generated by the signal processing section.

Numeral 9 is a developing unit loaded with black toner. In the same manner as described above, a black toner image is formed in registration on the belt surface. A DC and/or an AC bias voltage is impressed upon each developing sleeve of the developing units 6, 7, 8 and 9 and a jumping development operation is carried out by one-component or two-component developer so that the image on the photoreceptor belt 1 is reversal-developed under the noncontact condition.

In the manner described above, a color toner image is formed on the circumferential surface of the photoreceptor belt 1 while it is rotated by 4 revolutions. The color toner image is transferred onto a transfer sheet that is sent from the paper feed cassette 12 and conveyed by the timing roller 13.

Synchronously with the drive signal for the timing roller 13 sent from the control section, the electric power source for transfer is switched on, so that a transfer voltage is impressed upon the transfer sheet, and the toner image is transferred onto the transfer sheet from the photoreceptor belt 1. At this time, the electric power source for charging is switched off.

After the toner image has been transferred onto the transfer sheet, the transfer sheet is separated from the circumferential surface of the photoreceptor belt 1. After that, the toner image is fixed by the fixing unit 11, and then the transfer sheet is discharged onto the tray 15.

After the transfer sheet has been separated from the photoreceptor belt 1, the photoreceptor belt 1 starts the fifth revolution in which the blade 10A of the cleaning unit 10 is brought into pressure contact with the photoreceptor belt 1 so that the residual toner is removed and the belt surface is cleaned. Then, the photoreceptor belt 1 is charged again by the charger 4 and enters the successive image forming process.

In the aforementioned apparatus, the developing units are provided on one side of the photoreceptor belt 1 on which images are formed, and the cleaning unit 10 is provided on the other side of the photoreceptor belt 1.

The distance between the charging unit 4 and the cleaning blade 10A of the cleaning unit 10 through the developing units along the circumferential surface of the photoreceptor belt 1 is set a little longer than the maximum width of an image that can be formed by this apparatus, that is, the distance is set a little longer than the length of the maximum image size in the conveyance direction. Therefore, in the case after a color toner image formed on the photoreceptor belt 1 is started to be transferred, the transfer operation of the trailing edge of the image is completed before the leading edge reaches the cleaning blade 10A.

Figure 4:
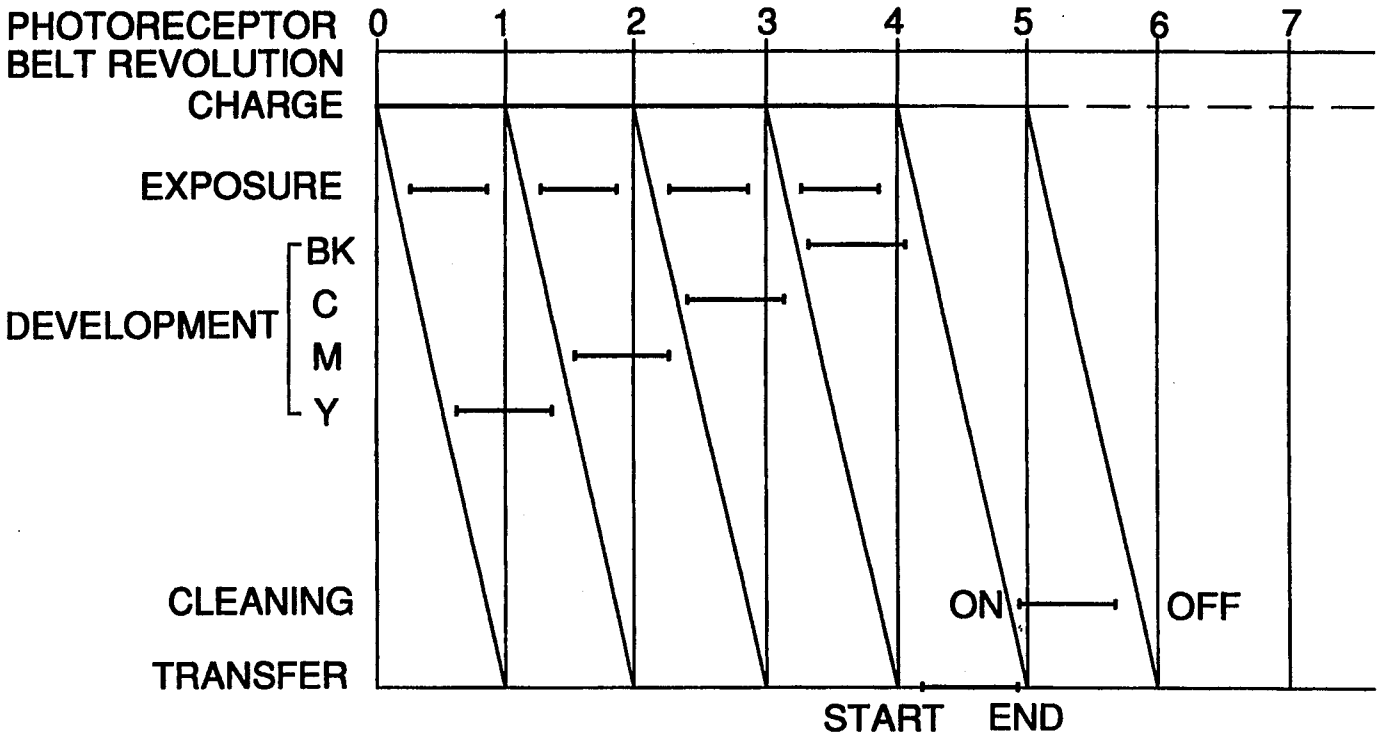
FIG. 4 is a time chart of image formation in the first example.

Accordingly, as shown in the time chart of FIG. 4, the cleaning blade 10A is separated from the circumferential surface of the photoreceptor belt 1 during the transfer operation, and then a cleaning operation of the cleaning blade 10A is started after the trailing edge of the image has been transferred. In this way, the image can be transferred without being affected when the cleaning blade 10A is activated.

When the transfer operation is started after a black (BK) development operation has been completed by the developing unit 9, the transfer operation is not affected by the vibration caused when the developing units are activated.

When image exposure is carried out after the cleaning blade 10A has been released from the surface of the photoreceptor belt 1, an electrostatic latent image of higher resolving power can be formed.

Figure 2:
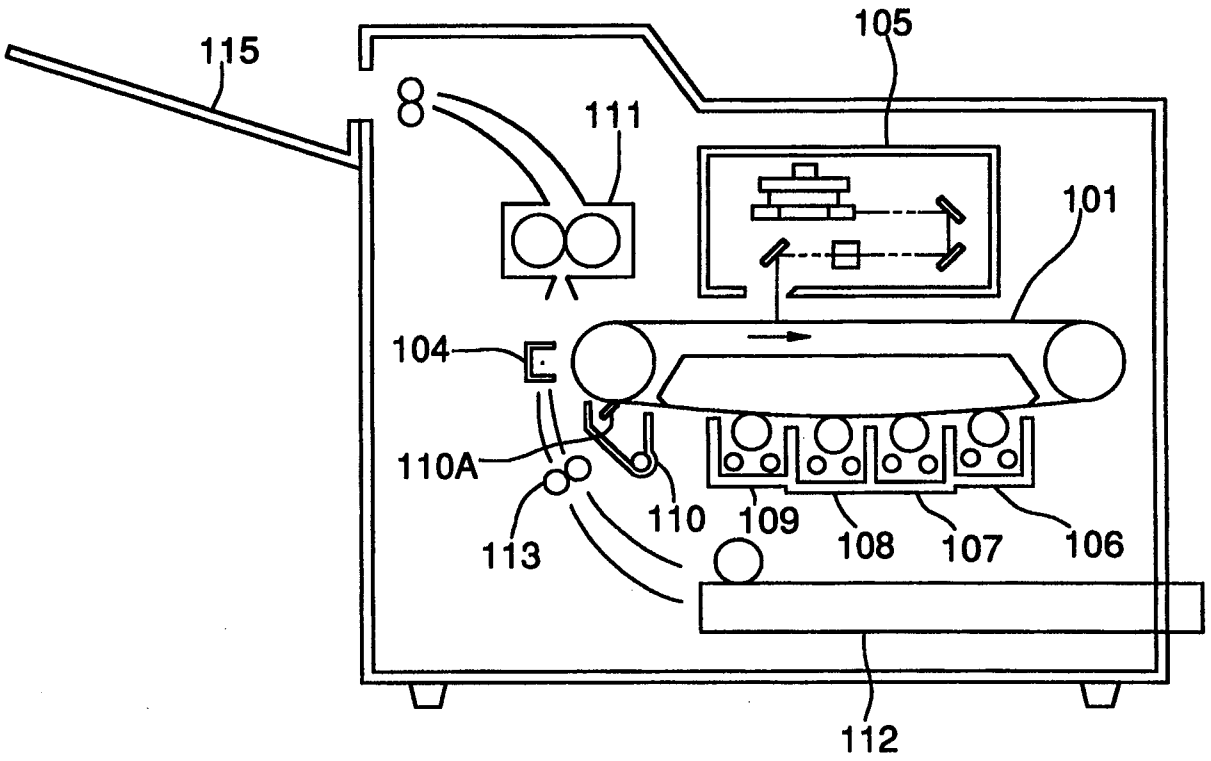
FIG. 2 a sectional view of a color image forming apparatus of the second example of the present invention.

FIG. 2 is a schematic illustration showing the second example of the present invention. In FIG. 2, a color image forming apparatus is shown in which the developing units 106 to 109 respectively accommodating yellow, magenta, cyan and black toner are provided on one side of the circumferential surface of the photoreceptor belt 101 horizontally disposed in the apparatus and also the cleaning unit 110 is successively provided. In this case,the distance between the charging unit 104 and the cleaning blade 110A of the cleaning unit 110 through the developing units along the circumferential surface of the photoreceptor belt. 101 is set a little longer than the maximum width of an image that can be formed by this apparatus, that is, the distance is set a little longer than the length of the image of the maximum size in the conveyance direction. Therefore, in the case where a color toner image formed on the photoreceptor belt 101 is transferred, the transfer operation of the trailing edge of the image is completed before the leading edge reaches the cleaning blade 110A.

In FIG. 2, reference numeral 105 is a writing system unit, as in FIG. 1; 111 is a fixing unit; 112 is a paper sheet magazine; 113 are feeding roller; and 115 is a tray for receiving recording sheets.

Figure 5:
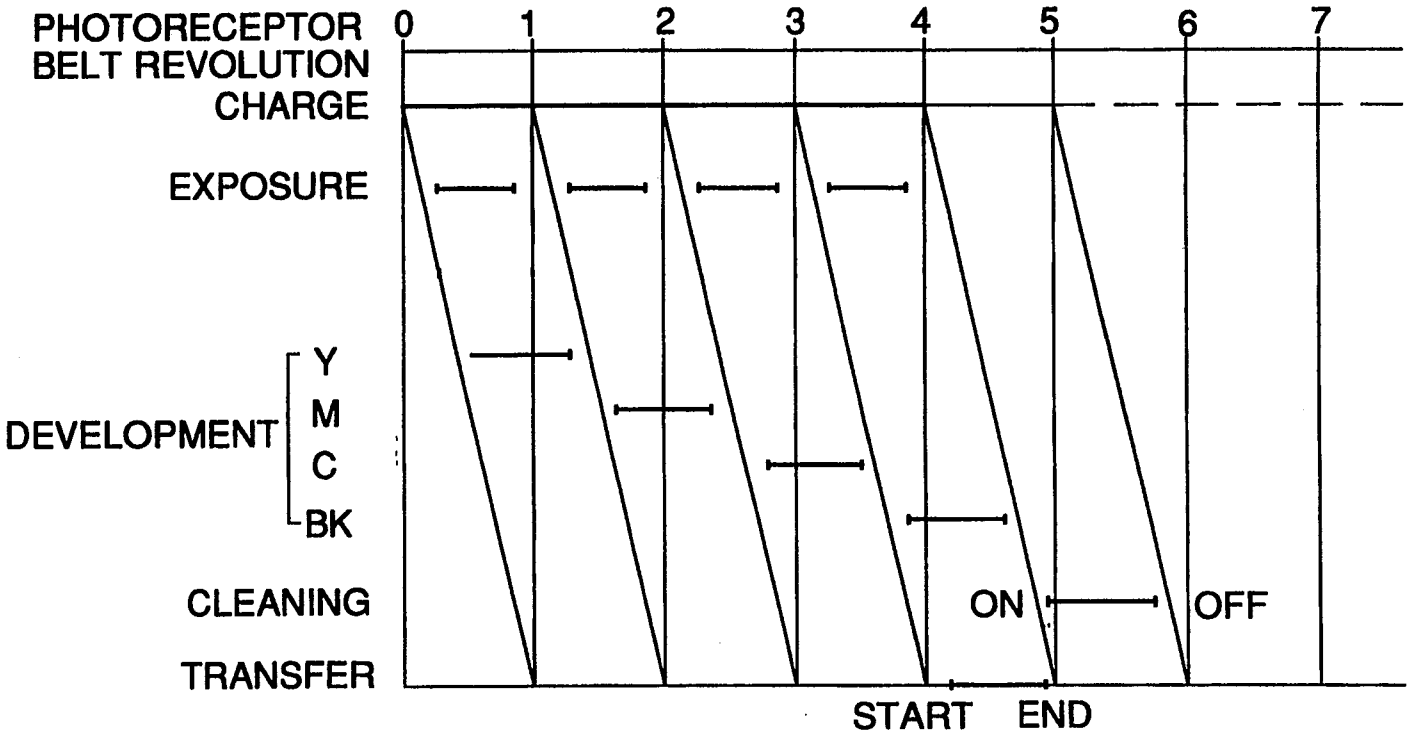
FIG. 5 is a time chart of image formation in the second example.

A time chart of image formation of this example is shown in FIG. 5. In the same way as the first example, a cleaning operation is not carried out during an image transfer operation. Therefore, images can be transferred without being affected by the operation of the blade 110A.

Figure 3:
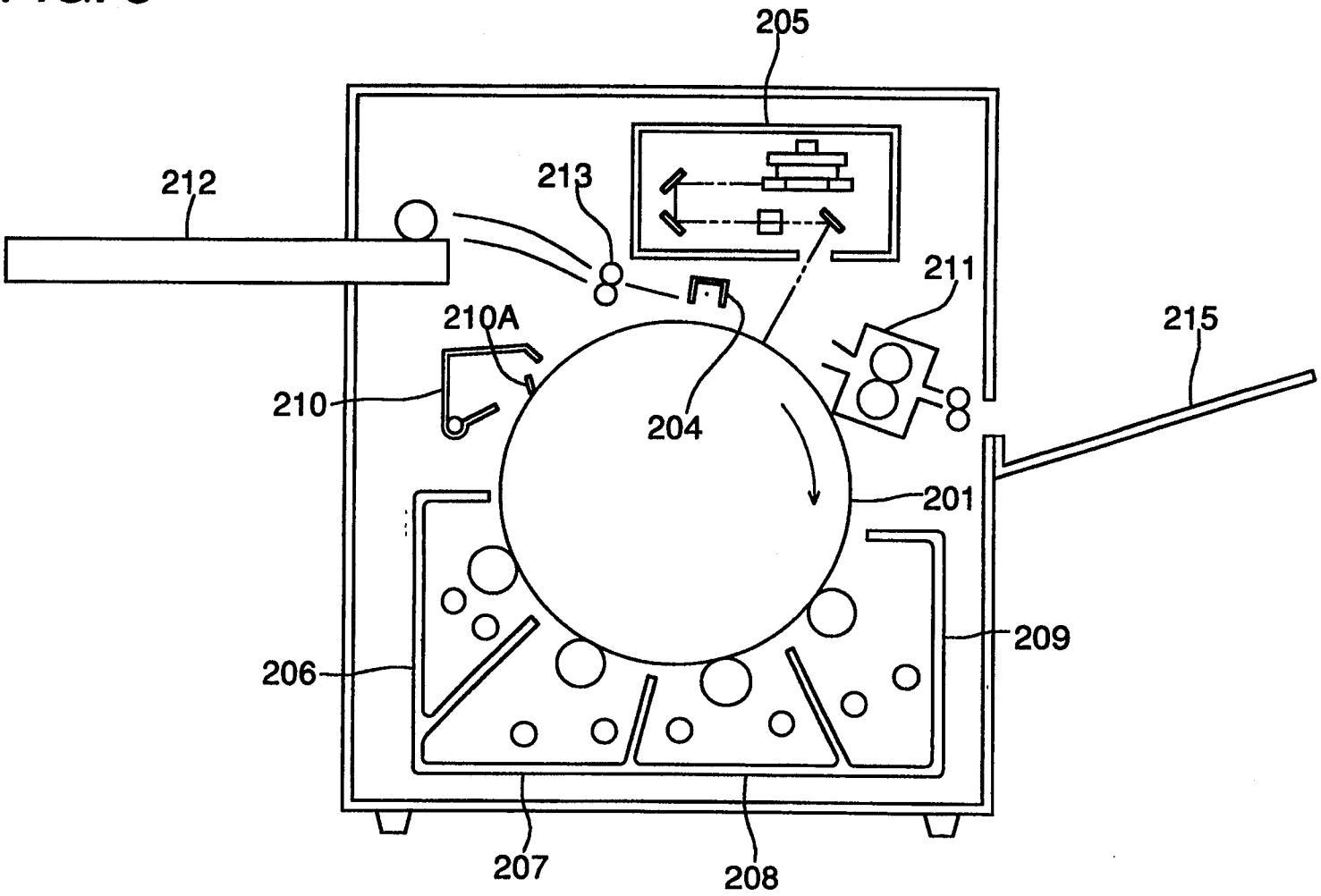
FIG. 3 is a sectional view of a color image forming apparatus of the third example of the present invention.

As the third example of the present invention shown in FIG. 3, the present invention can be applied to an image forming apparatus in which a drum-shaped photoreceptor drum 201 is used.

In FIG. 3, 205 is a writing system unit; 211 is a fixing unit; 212 is a paper sheet magazine; 213 are feeding rollers; and 215 is a tray for receiving recording sheets.

In this example, the large-sized photoreceptor drum 201 is used in which the distance from the charging unit 204 to the cleaning blade 210A of the cleaning unit 210 through the developing units is a little longer than the maximum width of an image that can be formed by this apparatus. When the developing units 209 to 206 accommodating black, cyan, magenta and yellow toner are successively disposed in the conveyance direction, the image transfer operations can be started and completed while the cleaning operation is not carried out in the same manner as the first example.

When a transfer operation is started after the completion of a black (BK) development operation conducted by the developing unit 209 in the same manner as the first example, the transfer operation is not affected by the vibration caused when the developing unit is activated.

When image exposure is carried out after the cleaning blade 210A has been released from the surface of the photoreceptor belt 1, an electrostatic latent image of higher resolving power can be formed.

According to the first, second and third examples of the present invention, an image can be transferred onto a transfer sheet without being affected by the fluctuation of the conveyance speed of the photoreceptor that is caused when the cleaning member is contacted with or released from the photoreceptor surface. As a result, an effective color image forming apparatus can be provided that can form color images of high quality even when the photoreceptor is rotated at the minimum number of revolutions.

Next, the fourth, fifth and sixth examples of the present invention will be explained as follows.

Figure 6:
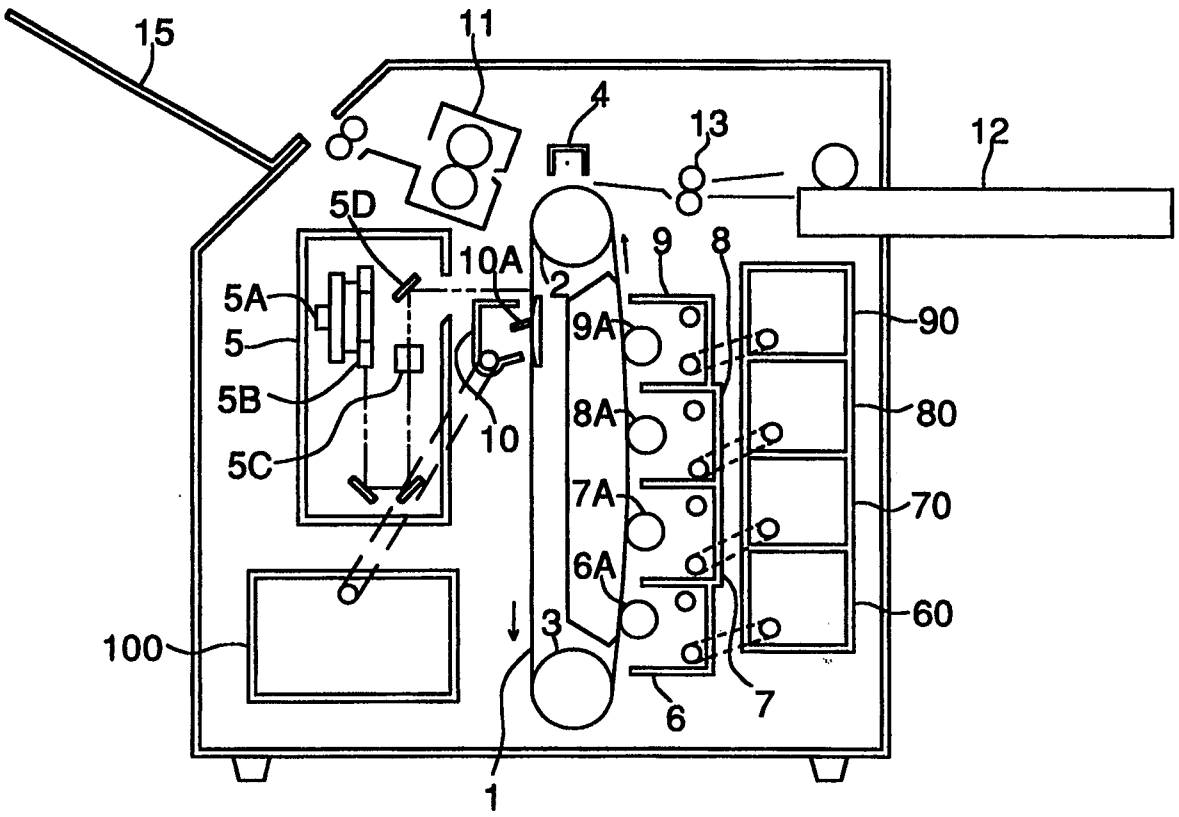
FIG. 6 is a sectional view of a color image forming apparatus of the fourth example of the present invention.

In FIG. 6 showing the fourth example, the distance between the charging unit 4 and the cleaning blade 10A of the cleaning unit 10 through the developing units 90, 80, 70 and 60 along the circumferential surface of the photoreceptor belt 1 is set a little longer than the maximum width of an image that can be formed by this apparatus, that is, the cleaning blade 10A comes into pressure contact (ON) with the circumferential surface of the photoreceptor belt 1 before the start of a transfer operation of a color toner image formed on the photoreceptor belt 1.

In FIG. 6, the reference numerals of like elements correspond to those shown in FIG. 1. In addition, reference numeral 5 is a laser scanning unit for writing a latent image on a photoreceptor; 5A is a drive motor; 5B is a polygonal mirror; 5D is a mirror; and 5C is a $2f\theta$ lens. Reference numeral 12 is a paper feed magazine for holding a plurality of sheets to be fed; reference numeral 13 are feeding rollers for feeding sheets to a transferring position; reference numeral 15 is a tray to receive a recording sheet. Reference numerals 60, 70, 80 and 90 are toner tanks for respectively supplying different toner colors to developers 6–9. Reference numeral 100 is a residual toner tank to collect residual toners from cleaner 10.

The cleaning blade 10A keeps in pressure contact (ON) with the photoreceptor belt 1 until the cleaning operation for the trailing edge of the transferred color toner image is completed, and before the photoreceptor belt 1 is charged again, the cleaning blade 10A is separated from the circumferential surface of the photoreceptor belt 1, that is, the cleaning blade 10A is released (OFF) from the circumferential surface of the photoreceptor belt 1.

Further, the cleaning blade 10A is contacted with the photoreceptor belt after image exposure on the trailing edge of an image has been completed and the trailing edge has passed through the cleaning blade 10A. Therefore, the electrostatic latent image is not affected by the cleaning operation conducted by the cleaning blade 10A.

Figure 9:
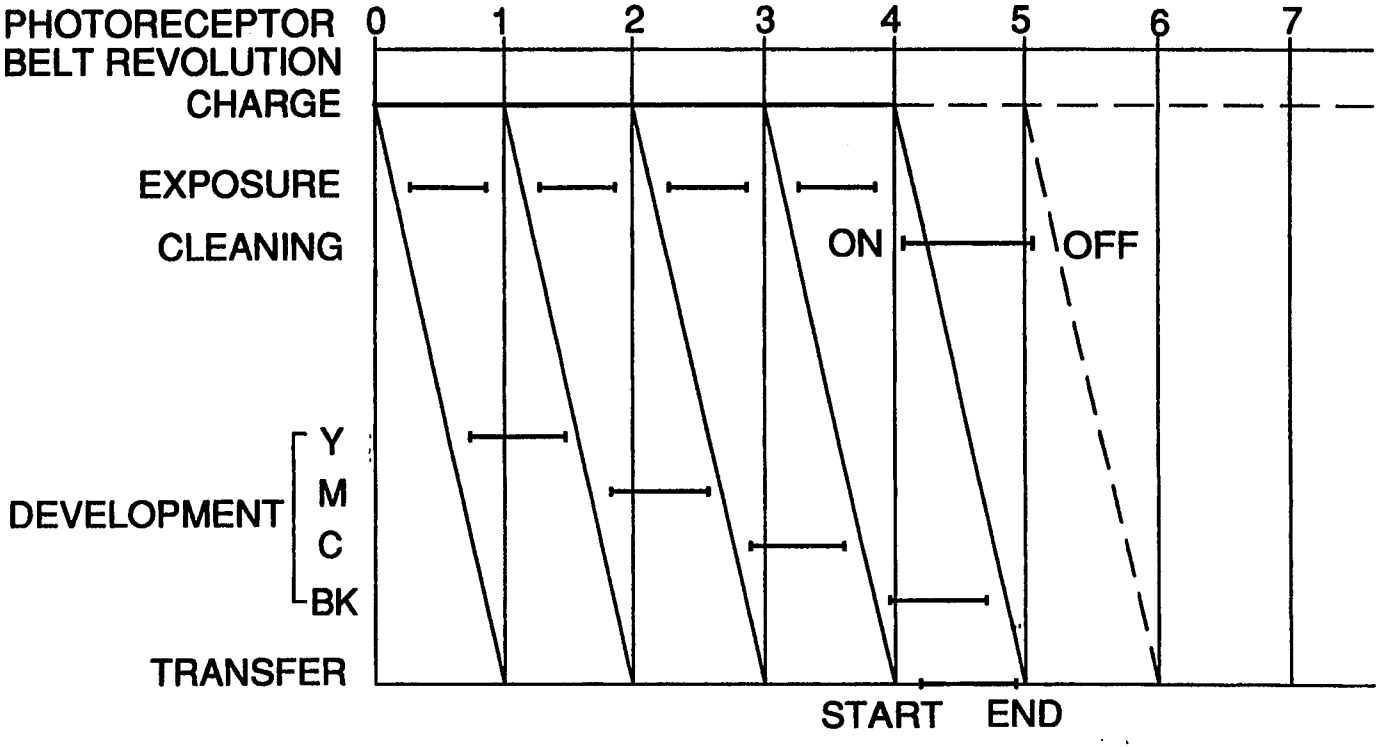
FIG. 9 is a time chart of image formation in the fourth example.

Consequently, as shown in the time chart of FIG. 9, the transfer operation is carried out during the cleaning operation. Therefore, the transfer operation is not affected by the cleaning blade 10A when it is contacted with (ON) or released from (OFF) the photoreceptor belt 1.

Figure 7:
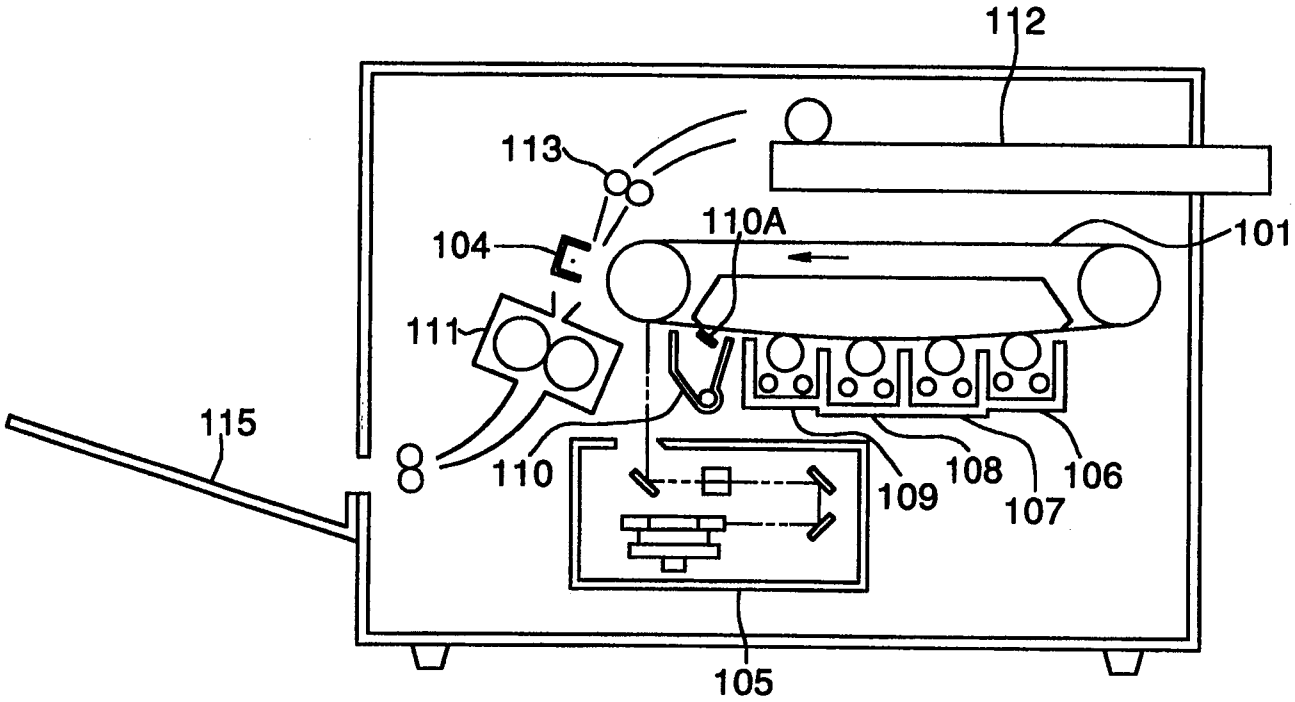
FIG. 7 is a sectional view of a color image forming apparatus of the fifth example of the present invention.

FIG. 7 is a schematic illustration showing the fifth example of the present invention. In FIG. 7, a color image forming apparatus is shown in which the cleaning unit 110 and the developing units 109 to 106 respectively accommodating black, cyan, magenta and yellow toner are provided on one side of the circumferential surface of the photoreceptor belt 101 horizontally disposed in the apparatus. In this case, the distance between the charging unit 104 and the cleaning blade 110A of the cleaning unit 110 through the developing units along the circumferential surface of the photoreceptor belt 101 is set a little longer than the maximum width of an image that can be formed by this apparatus. As a result of the foregoing, the cleaning blade 110A comes into pressure contact with (ON) the photoreceptor belt 1 before the start of the transfer of the color toner image on the photoreceptor belt 1, and the cleaning operation of the trailing edge of the image can be completed before a portion corresponding to the leading edge of the cleaned image is charged.

In FIG. 7, 105 is a writing system unit; 111 is a fixing unit; 112 is a paper sheet magazine; 113 are feeding rollers; and 110 is a cleaning unit.

Figure 10:
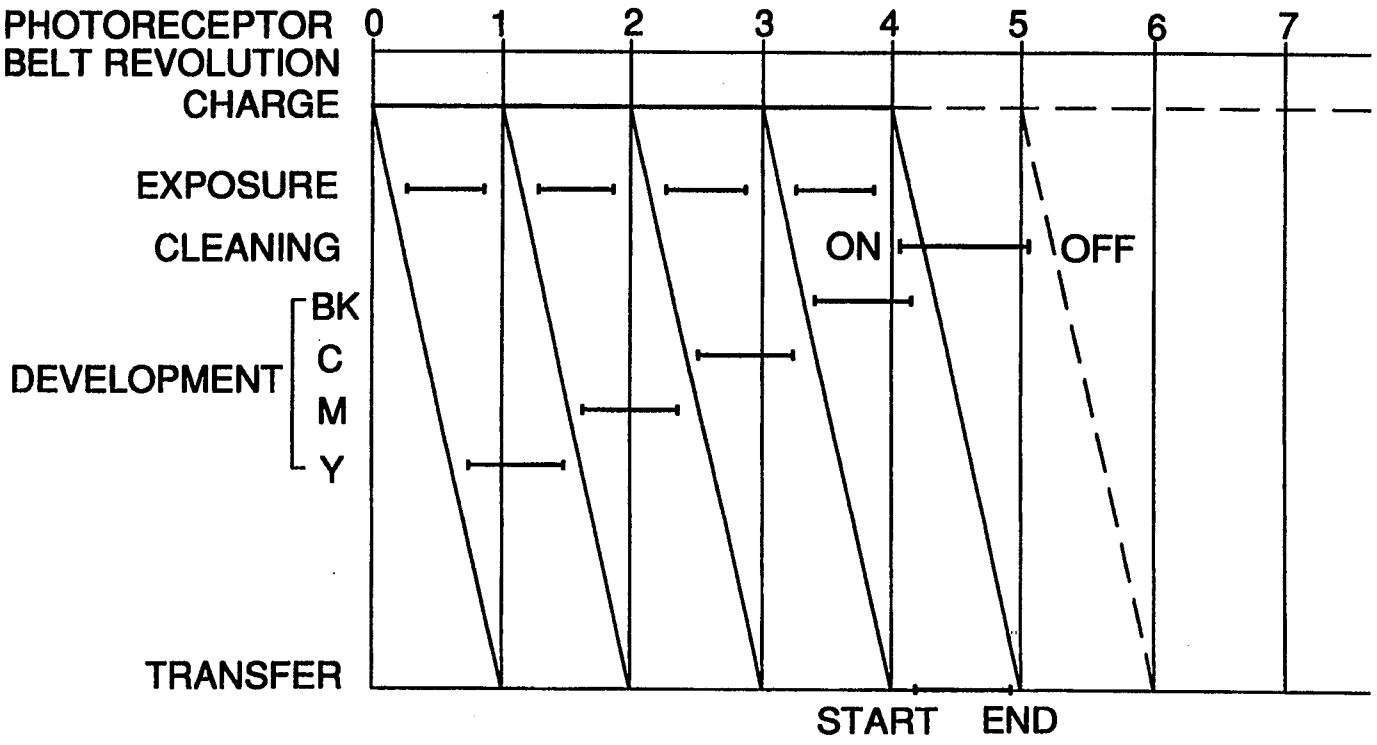
FIG. 10 is a time chart of image formation in the fifth example.

A time chart of image formation of this example is shown in FIG. 10. In the same manner as the first example, a transfer operation is carried out while the photoreceptor surface is being cleaned, so that the transfer operation is not affected by the cleaning blade 110A.

Figure 8:
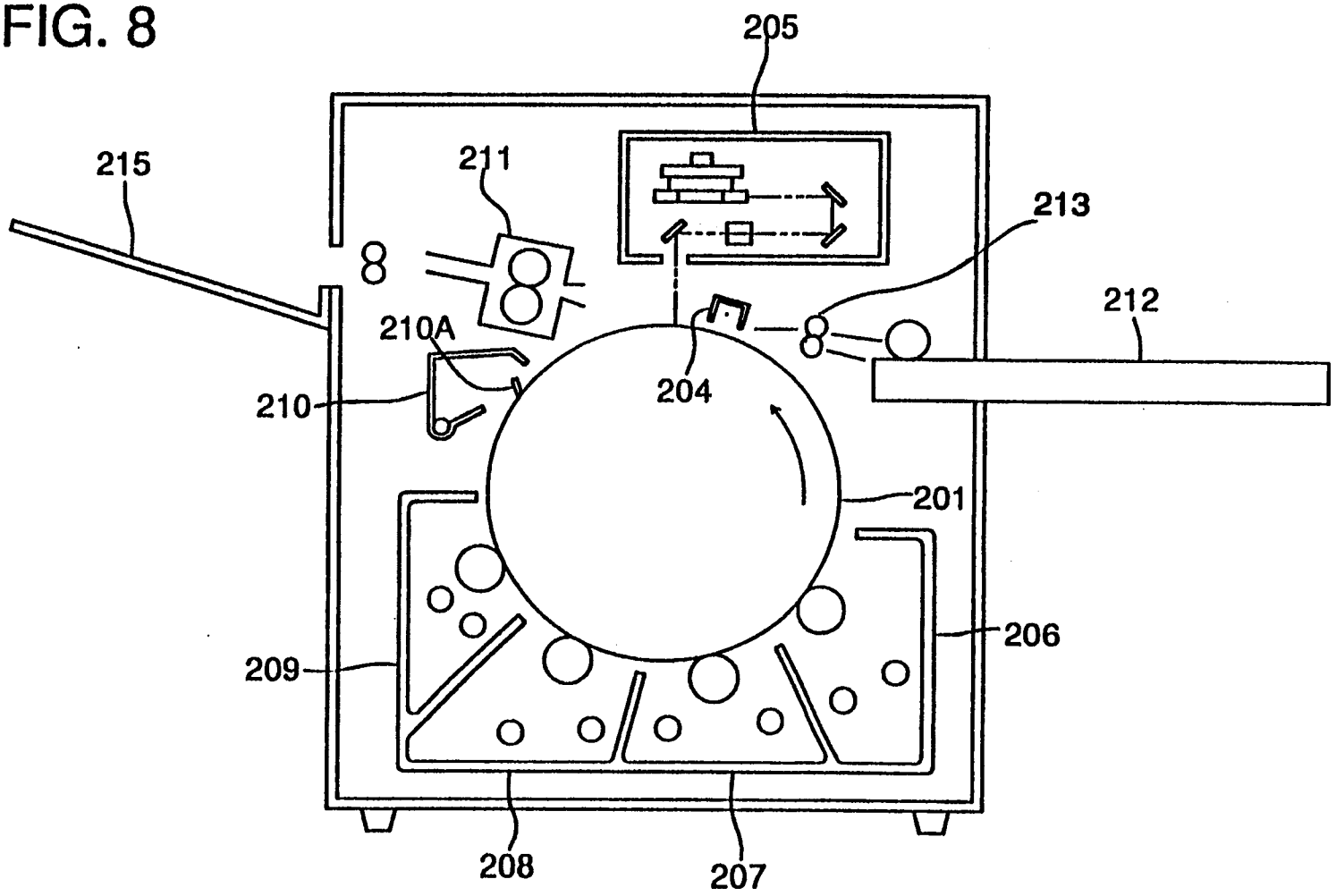
FIG. 8 is a sectional view of a color image forming apparatus of the sixth example of the present invention.

In FIG. 8, 205 is a writing system unit; 211 is a fixing unit; 212 is a paper sheet magazine; 213 are feeding rollers; and 215 is a tray for receiving recording sheets.

The sixth example of the present invention is shown in FIG. 8. In the drawing, an image forming apparatus is illustrated in which a drum-shaped photoreceptor 201 is used. The present invention can be applied to the aforementioned apparatus.

In this example, the large-sized photoreceptor drum 201 is used in which the distance from the charging unit 204 to the cleaning blade 210A of the cleaning unit 210 through the developing units is a little longer than the maximum width of an image that can be formed by this apparatus. When the developing units 209 to 206 accommodating black, cyan, magenta and yellow toner are successively disposed in the conveyance direction, the image transfer operations can be started and completed while the cleaning operation is being carried out in the same manner as the fourth example.

In the aforementioned example, before the start of the transfer operation of a color toner image formed on the photoreceptor drum 201, the cleaning blade 210A comes into pressure contact (ON) with the circumferential surface of the photoreceptor belt 201. Further, after image exposure has been conducted on the trailing edge of an image and the trailing edge has passed through the cleaning blade 210A, the cleaning blade 210A is contacted with pressure (ON). Therefore, the formation of the electrostatic latent image is not affected by the operation of the cleaning blade 210A.

In the fourth to sixth examples of the present invention, an image can be transferred onto a transfer sheet without being affected by the fluctuation of the conveyance speed caused when the cleaning member is contacted with or released from the photoreceptor surface. As a result, an effective color image forming apparatus can be provided that can form color images of high quality even when the photoreceptor is rotated at the minimum number of revolutions.

What is claimed is:

1. An image forming apparatus for forming a color image on a recording sheet, comprising:

carrying means, having a surface, for carrying the color image;

means for forming a latent image of said color image on said surface of said carrying means;

a plurality of color developing means for developing said latent image so that a plurality of developed color images are superimposed and a multicolor toner image is formed on said surface of said carrying means;

means for transferring said multicolor toner image from said carrying means to the recording sheet at once;

means for cleaning a residual portion of said transferred multicolor toner image remaining on said carrying means after said multicolor toner image is transferred to said recording sheet; wherein:

said plurality of color developing means, said transferring means, and said cleaning means are positioned to face toward said surface of said carrying means; and a length of said surface as measured in a rotating direction of said carrying means between said transferring means and said cleaning means through said plurality of color developing means is longer than a length of said color image; and said latent image forming means, said plurality of color developing means, said transferring means, and said cleaning means are positioned in the following sequence: 1) said latent image forming means; 2) said plurality of color developing means; 3) said cleaning means; and 4) said transferring means, when viewed in a rotating direction of said carrying means;

control means for controlling a cleaning operation of said cleaning means; and wherein said control means starts a cleaning operation after said means for transferring completes a transfer of said multicolor toner image to said recording sheet.

2. The image forming apparatus of claim 1, wherein said carrying means comprises a belt type photoreceptor.

3. The image forming apparatus of claim 2, wherein said plurality of color developing means are located at a first side in the image forming apparatus, and said cleaning means is located at a side opposite to said first side with said belt type photoreceptor positioned as a center in the image forming apparatus.

4. The image forming apparatus of claim 1, wherein said carrying means comprises a drum type photoreceptor.

5. An image forming apparatus for forming a color image on a recording sheet, comprising:

carrying means, having a surface, for carrying the color image;

means for forming a latent image of said color image on said surface of said carrying means;

a plurality of color developing means for developing said latent image so that a plurality of developed color images are superimposed and a multicolor toner image is formed on said surface of said carrying means;

means for transferring said multicolor toner image from said carrying means to the recording sheet at once;

means for cleaning a residual portion of said transferred multicolor toner image remaining on said carrying means after said multicolor toner image: is transferred to said recording sheet; wherein:

said plurality of color developing means, said transferring means, and said cleaning means are positioned to face toward said surface of said carrying means; and a length of said surface as measured between said transferring means and said cleaning means through said plurality of color developing means as measured in a rotating direction of said carrying surface is longer than a length of :said color image; and said latent image forming means, said plurality of color developing means, said transferring means, and said cleaning means are positioned in the following sequence: 1) said latent image forming means; 2) said cleaning means; 3) said plurality of color developing means; and 4) said transferring means, when viewed in a rotating direction of said carrying surface;

control means for controlling a cleaning operation of said cleaning means; and wherein said control means starts a cleaning operation after a completion of a latent image forming operation of said image forming means and before a beginning of a transfer operation of said transferring means.

6. The image forming apparatus of claim 5, wherein said carrying means comprises a belt type photoreceptor.

7. The image forming apparatus of claim 6, wherein said plurality of color developing means and said cleaning means are located on one side of said belt type photoreceptor in the image forming apparatus.

8. The image forming apparatus of claim 5, wherein said carrying means comprises a drum type photoreceptor.

9. An image forming apparatus for forming a color image on a recording sheet, comprising:

means, having a surface, for carrying the color image;

means for forming a latent image of said color image on said surface of said carrying means;

a plurality of color developing means for developing said latent image so that a developed color image is formed on said surface of said carrying means;

means for transferring said developed color image from said carrying means to the recording sheet;

cleaning means for cleaning a residual portion of said developed color image on said carrying means;

wherein said plurality of color developing means, said transferring means, and said cleaning means are located facing toward said surface of said carrying means; and a length of said surface between said transferring means and said cleaning means through said plurality of color developing means is longer than a length of said color image; and control means for controlling a cleaning operation of said cleaning means;

wherein said cleaning means starts said cleaning operation after said transferring operation is completed; and wherein said carrying means comprises a drum type photoreceptor.

10. The image forming apparatus of claim 9, wherein said plurality of color developing means are located at a first side in the image forming apparatus, and said cleaning means is located at a side opposite to said first side with said drum type photoreceptor positioned as a center in the image forming apparatus.

11. The image forming apparatus of claim 9, wherein said plurality of color developing means and said cleaning means are located on one side of said drum type photoreceptor in the image forming apparatus.

* * * * *